US007082949B2

(12) United States Patent
Julemont

(10) Patent No.: US 7,082,949 B2
(45) Date of Patent: Aug. 1, 2006

(54) HEATING HAIR CURLER

(75) Inventor: Pierre L.M. Julemont, Argenteau (BE)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 11/014,266

(22) Filed: Dec. 16, 2004

(65) Prior Publication Data

US 2005/0172980 A1 Aug. 11, 2005

(30) Foreign Application Priority Data

Jun. 23, 2003 (EP) ..... EP03447169
Apr. 5, 2004 (BE) ..... PCT/BE04/00065

(51) Int. Cl.
*A45D 6/02* (2006.01)

(52) U.S. Cl. ..... 132/266; 132/268

(58) Field of Classification Search ..... 132/266, 132/268, 227, 229–240; 219/222, 225; 126/408, 126/409; 431/268, 344, 345
See application file for complete search history.

(56) References Cited

U.S. PATENT DOCUMENTS

| | | | | |
|---|---|---|---|---|
| 0,866,778 | A | 9/1907 | Eldridge | |
| 1,377,655 | A * | 5/1921 | Begas | 132/229 |
| 1,488,005 | A | 3/1924 | Freeman | |
| 1,491,415 | A | 4/1924 | Pegelow | |
| 1,652,279 | A * | 12/1927 | Jacobs | 132/266 |
| 1,663,078 | A * | 3/1928 | Harper | 132/118 |
| 1,848,093 | A * | 3/1932 | Ackley | 132/230 |
| 2,239,119 | A * | 4/1941 | Rutledge | 132/239 |
| 2,335,086 | A | 11/1943 | Ryan | |
| 2,595,844 | A * | 5/1952 | Graham | 132/235 |
| 2,783,763 | A | 3/1957 | King | |
| 3,747,610 | A | 7/1973 | Serrat | |
| 4,211,245 | A | 7/1980 | Coppola | |
| 4,249,550 | A | 2/1981 | Cassidy | |
| 4,258,732 | A | 3/1981 | Mariani | |
| 4,284,091 | A | 8/1981 | Ehmann | |
| 4,464,562 | A | 8/1984 | Takimae | |
| 4,569,360 | A | 2/1986 | Glucksman | |
| D287,298 | S | 12/1986 | Kibe et al. | |
| 4,740,669 | A | 4/1988 | Takimae | |
| 4,829,155 | A | 5/1989 | Fukutuka et al. | |
| 4,955,401 | A | 9/1990 | Parsons | |
| 4,984,591 | A | 1/1991 | Jacobi | |
| 5,046,516 | A | 9/1991 | Barradas | |
| 5,193,558 | A | 3/1993 | Squatrito | |
| 5,212,366 | A | 5/1993 | McDougall | |
| 5,215,107 | A | 6/1993 | Van Divner | |
| D345,626 | S | 3/1994 | Izzo | |
| 5,626,156 | A | 5/1997 | Vicory, Sr. | |
| 5,740,820 | A | 4/1998 | Stern | |

(Continued)

*Primary Examiner*—Todd E. Manahan
*Assistant Examiner*—Rachel Running
(74) *Attorney, Agent, or Firm*—Lawrence Cauz; Steven A. Garner

(57) ABSTRACT

A heating hair curler comprising a handle with at least one clamp and at least one push button and a heating unit for setting locks of hair, in which the heating unit has a relief in the form of a worm screw, called a fixed spiral profile, fixed to the heating unit, and in which the hair curler also comprises a mobile spiral profile which can be moved along the longitudinal axis of the heating unit by means of the push button so as to compress the lock of hair coiled into a spiral around the hair curler between the fixed spiral and the mobile spiral and thus so as to heat the lock on at least two sides at the same time.

11 Claims, 4 Drawing Sheets

U.S. PATENT DOCUMENTS 5,791,356 A 8/1998 Muzzipapa
5,810,026 A 9/1998 Sham
5,862,813 A 1/1999 Bugane
5,868,146 A 2/1999 Henninger
5,983,903 A * 11/1999 Nanba et al. ..... 132/228
6,223,753 B1 * 5/2001 Lo ..... 132/224
6,354,305 B1 3/2002 Janouch et al.
6,604,532 B1 8/2003 McClendon et al.
6,722,498 B1 4/2004 Westfield et al.
2003/0000542 A1 * 1/2003 Huntley ..... 132/232
2004/0069316 A1 4/2004 Kraus

* cited by examiner

HEATING HAIR CURLER

CROSS-REFERENCE TO RELATED APPLICATIONS

This application claims priority to International Application No. PCT/BE04/00006 filed on Apr. 5, 2004 and European Patent No. EP03447169 filed Jun. 23, 2003, both incorporated herein by reference in their entirety.

BACKGROUND OF THE INVENTION

1. Field of the Invention

The present invention relates to the area of hair styling and more specifically to a new heating hair curler with a particular coiling profile allowing one to obtain locks of hair in the form of a spiral.

2. Description of Related Art

There are many portable heating hair curlers on the market which, under one form or another, are all based on the principle of coiling the hair around a heating unit. This type of device is sometimes provided with a lever for pressing the hair against it and allows one to maintain the lock of hair in place before and/or during coiling.

Some models are also provided with teeth or combs allowing to align the hair around a heating unit and to comb the lock at the same time. Regardless of the presence of a pressure lever, the hair is generally only heated on one side at a time. Usually, when the lock of hair is heated on only one side at a time, the heat is not homogeneously transmitted to the entire mass of the lock of hair. Hence, this does not allow to obtain a quick result with a long-lasting lock in the form of a spiral.

EP-A-0021941 discloses a heating hair curler presenting a heating unit and a helical rod for pressing the hair against the heating unit. This system offers no possibility to heat the lock of hair on several sides at the same time during the compression of the hair lock against the heating unit.

OBJECTS AND SUMMARY OF THE INVENTION

The present invention aims to disclose a heating hair curler which does not have the drawbacks of the state of the art and which is capable of heating the lock of hair on several sides at the same time during the compression phase of the lock in order to make the operation quicker and to render the spiral-shaped set longer-lasting.

The present invention discloses a heating hair curler comprising a handle with at least one clamp and at least one push button and a heating unit for setting locks of hair, characterized in that the heating unit comprises a relief shaped like a worm screw, called a fixed spiral profile, which is fixed to the heating unit, and in that the hair curler also comprises a mobile spiral profile which can be moved along the longitudinal axis of the heating unit by means of the push button so as to compress the lock of hair coiled into a spiral around the hair curler between the fixed spiral and the mobile spiral and thus so as to heat the lock on at least two sides at the same time.

One particular feature of the invention shows that the push button allows one to compress the lock of hair coiled into a spiral around the hair curler between the fixed spiral and the mobile spiral and thus allows a user to heat the lock on three sides at a time.

One additional feature of the present invention shows that the mobile spiral profile has a shape and a cross-section that perfectly fit the cross-section of the fixed spiral profile so as to be able to uniformly compress the lock between the fixed and mobile spiral profiles.

One additional feature of the present invention shows that the mobile spiral profile has exactly the same screw pitch as the fixed spiral profile and that, in the closed position, the spirals perfectly fit together.

According to one preferred embodiment of the invention, the mobile spiral profile has an essentially square or rectangular cross-section.

According to one particular embodiment of the device of the invention, the clamp allows a user to maintain the end of the lock so as to allow it to be coiled into a spiral around the heating unit.

Still according to the invention, the push button can push the mobile spiral profile against the fixed spiral profile in order to trap the lock of hair between the mobile and fixed spiral profiles.

Finally, the present invention discloses a mobile spiral profile preferably made out of a material that is a good heat conductor.

DETAILED DESCRIPTION OF THE INVENTION

Figure 1:
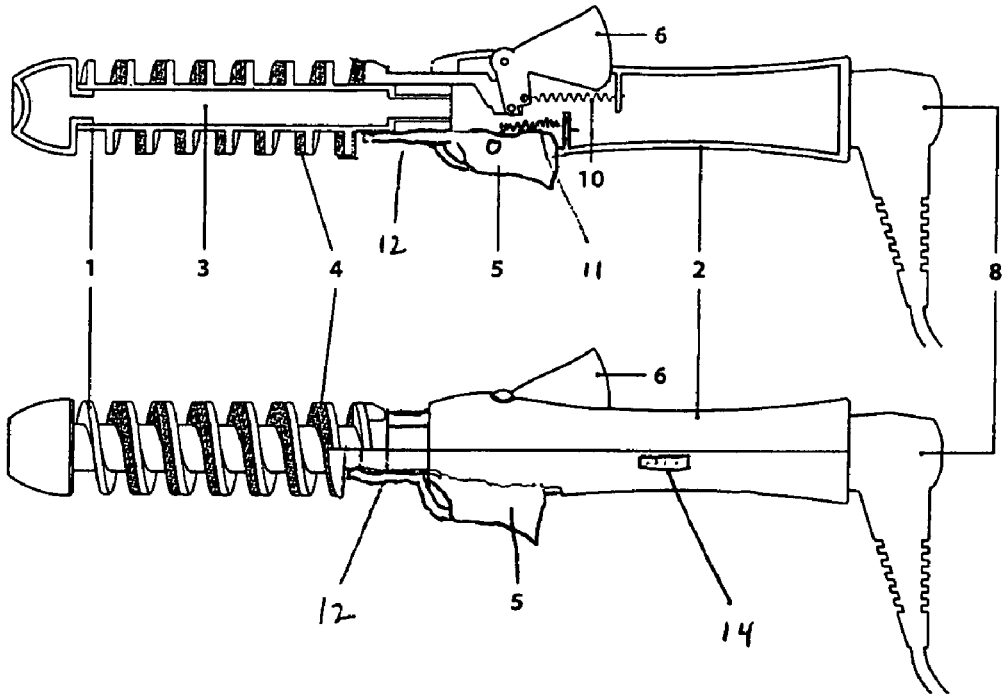
FIG. 1 shows a front view and a view in longitudinal section of the heating hair curler in accordance with an illustrative embodiment of the present invention.
Figure 2:
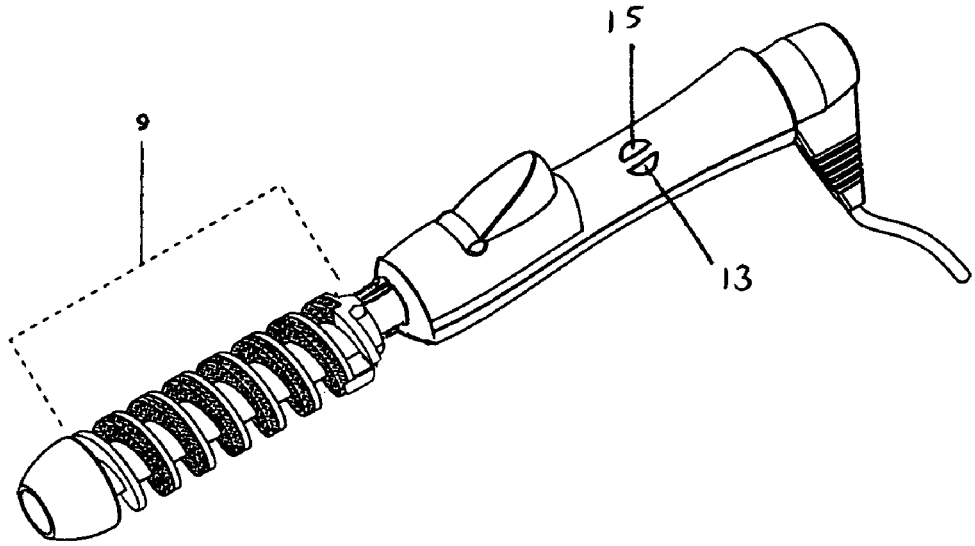
FIG. 2 shows a perspective view of the heating hair curler in accordance with an illustrative embodiment of the present invention.

As shown in FIGS. 1 and 2, the heating hair curler according to the present invention comprises a heating unit of essentially cylindrical shape with a heating resistance 3 inside and with a relief in the form of a worm screw 9 fixed to the heating unit which shall be called the fixed spiral profile or fixed spiral 1.

The heating hair curler also comprises a mobile spiral profile 4 with a square or rectangular cross-section in the form of a worm screw of the same pitch and the same height as the relief of the worm screw fixed to the heating unit, i.e. of the fixed spiral profile 1.

As for terminology, we shall indiscriminately speak of a fixed spiral or of a fixed spiral profile as well as of a mobile spiral or of a mobile spiral profile.

It is very important for the pitches and the cross-sections of the fixed and mobile spiral profiles to be substantially identical so as to allow even pressure on the lock of hair and close contact between the mobile part 4 and the fixed part 1, in particular in order to ensure effective heating of the mobile part 4 by the fixed part 1. The mobile spiral 4 thus perfectly fits the fixed spiral 1 attached to the heating unit.

The mobile spiral profile 4 can slide back and forth on the heating unit along the axis of the latter in order to allow the lock of hair 7 to be trapped between the mobile spiral 4 and the fixed spiral 1.

The heating hair curler can also include a power button 13 to provide power to the hair curler to cause the hair curler to heat. The hair curler can also include a dial 14 to enable a user to selectively control the temperature of the barrel to accommodate various types of hair, as well as a turbo button 15 to increase the temperature of the barrel by up to 20 degrees Celsius.

Figure 3:
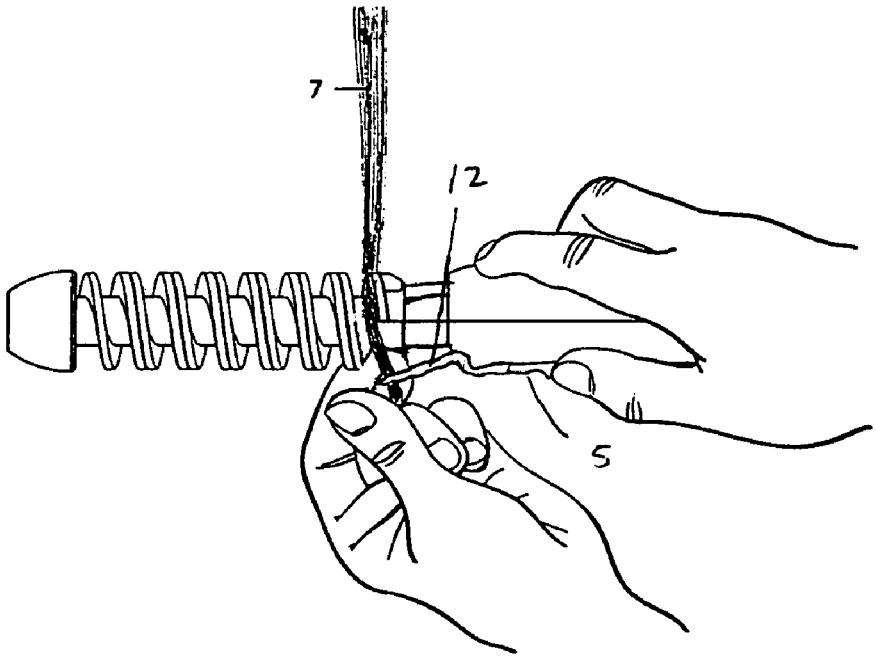
FIG. 3 shows a side view of the heating curler in accordance with an illustrative embodiment of the present invention.

As shown in FIG. 3, a clamp 12, located on the handle 2 of the hair curler, allows the end of the lock 7 to be gripped before it is coiled around the hair curler according to the invention. The clamp 12 is lifted by depressing a clamp button 5 and the end of the lock 7 is then placed against the barrel beneath the clamp 12. When the clamp button 5 is released, the clamp closes to firmly hold the end of the lock 7 in place.

Figure 4:
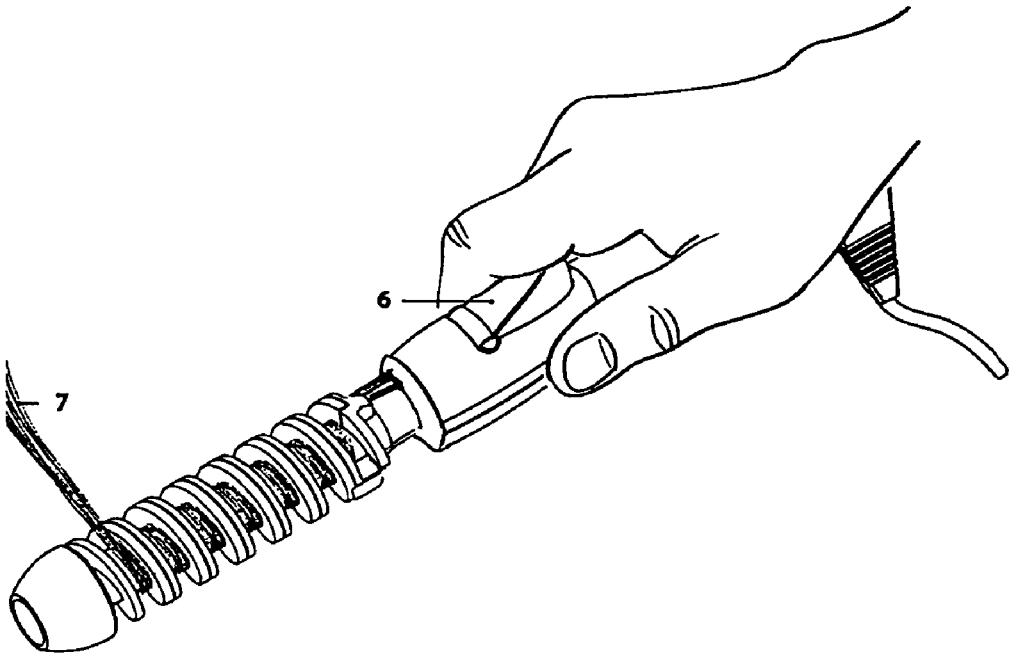
FIG. 4 shows a perspective view of the heating hair curler in accordance with an illustrative embodiment of the present invention.
Figure 5:
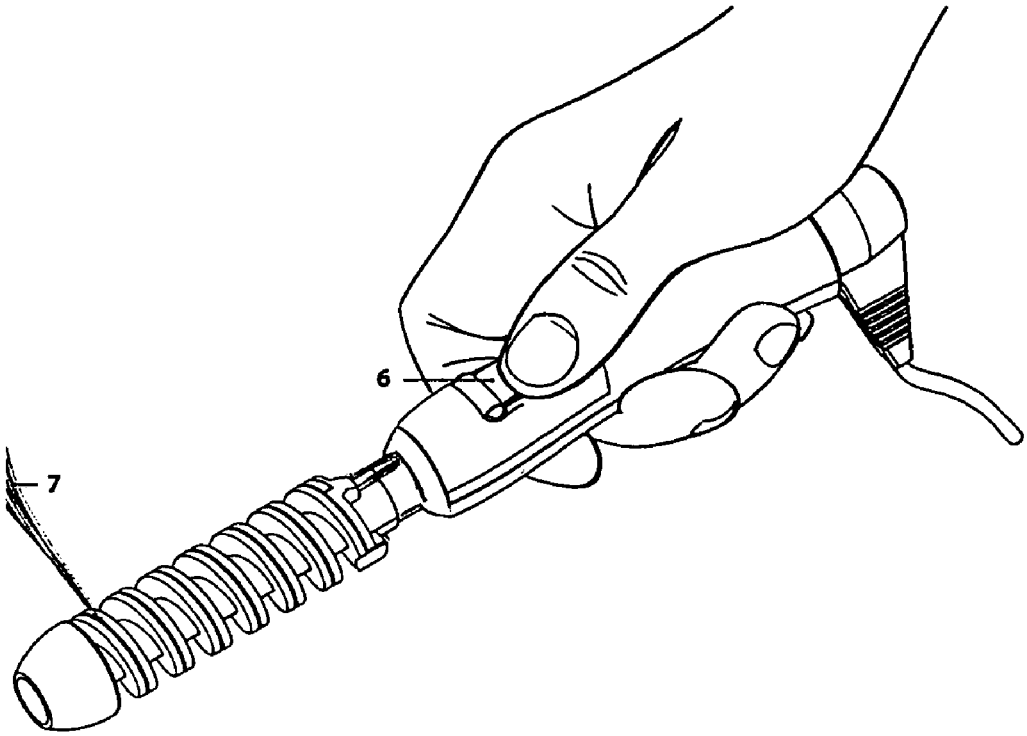
FIG. 5 shows a perspective view of the heating hair curler in accordance with an illustrative embodiment of the present invention.

A push button 6 then allows one to compress the lock between the mobile spiral profile 4 and the fixed spiral profile 1, as illustrated in FIGS. 4 and 5. As the push button 6 is depressed, the mobile spiral 4 is pushed along the barrel toward the fixed spiral 1 until the lock of hair 7 is squeezed between the fixed spiral 1 and the mobile spiral 4. The lock of hair 7 is then heated by the barrel, the fixed spiral 1 and the mobile spiral 4. The clamp button 5 and the push button 6 are provided with release springs 11 and 10, respectively, which allow the various mobile elements to return to their original positions.

Figure 6:
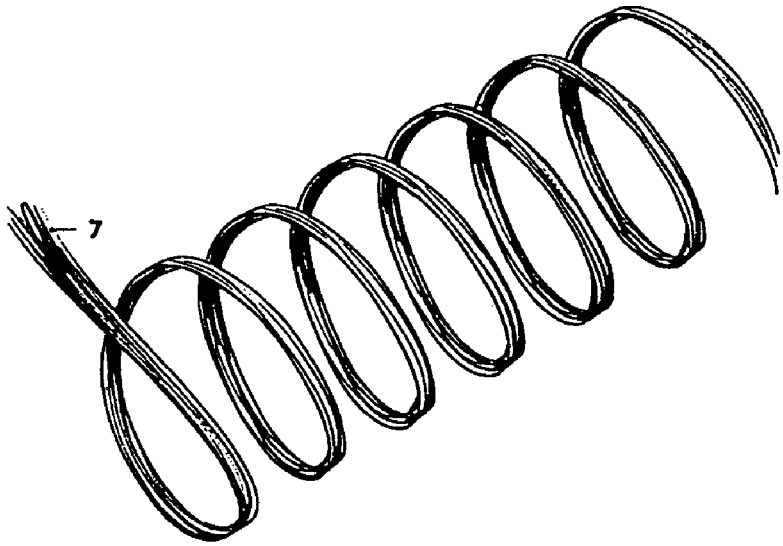
FIG. 6 shows the shape of a lock of hair in accordance with an illustrative embodiment of the present invention.

To the extent that the hair is coiled around the heating tube in the hole of the pitch formed by the mobile and fixed spiral profiles, it is heated on three sides at the same time when it is trapped between the mobile spiral profile 4 and the fixed spiral profile 1 to provide a curled lock of hair 7, such as is shown in FIG. 6, for example. This feature very clearly distinguishes the heating hair curler of the present invention from the heating tongs according to the state of the art, which generally only allow the hair to be heated on one side at a time.

Figure 7:
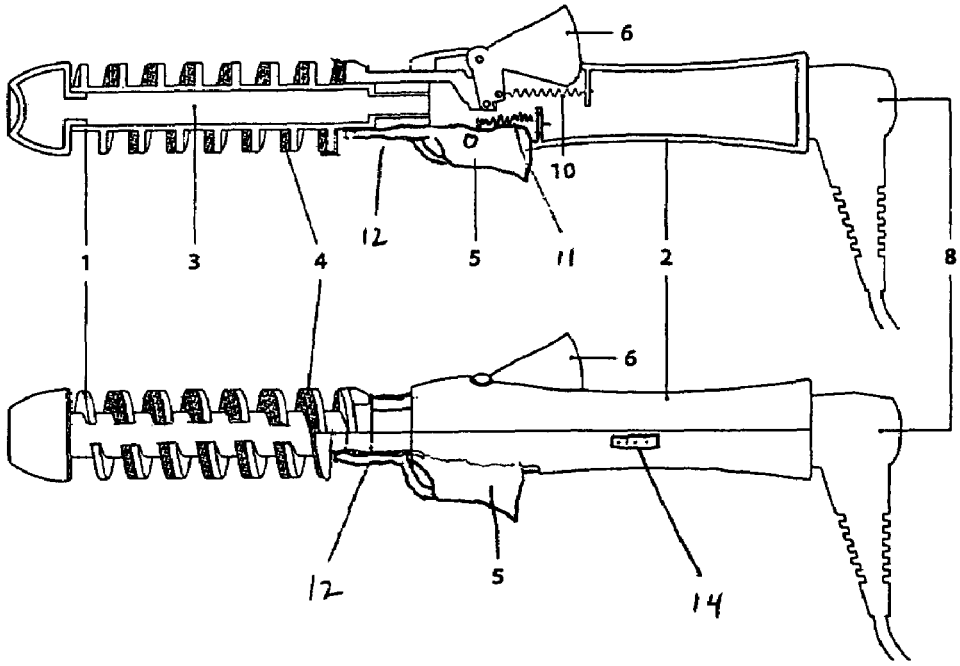
FIG. 7 shows a front view and a view in longitudinal section of the heating hair curler in accordance with an alternate embodiment of the present invention.
Figure 8:
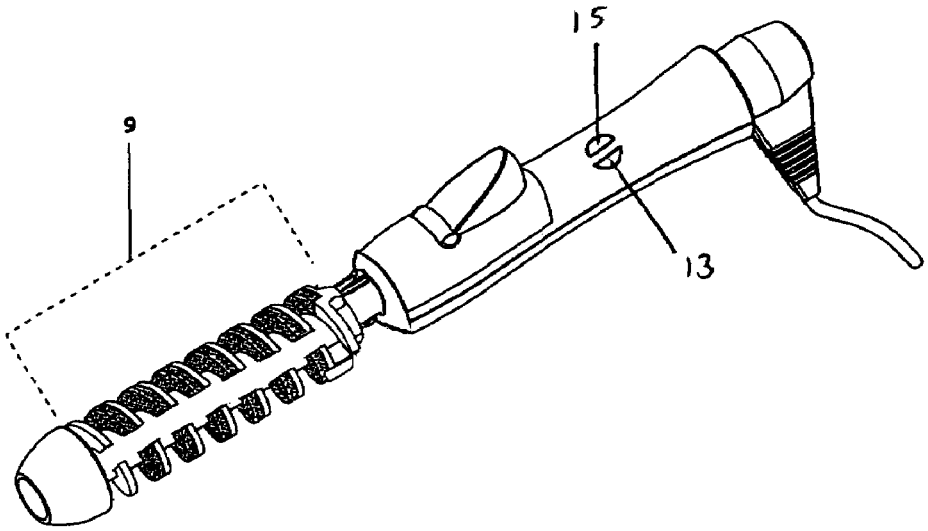
FIG. 8 shows a perspective view of the heating hair curler in accordance with an alternate embodiment of the present invention.

The fixed spiral 1 and mobile spiral 4 can have various configurations and need not necessarily be in the shape of a helix. Fox example, as shown in FIGS. 7 and 8, the fixed spiral 1 and mobile spiral 4 can be partial spirals that partially revolve around the barrel.

While a preferred embodiment of the invention has been herein disclosed and described, it is understood that various modifications can be made without departing from the scope of the invention.

What is claimed is:

1. A hair curler comprising:

a handle;

a barrel extending from an end of said handle;

a heater within said barrel adapted to provide heat to said barrel;

a first member extending radially from said barrel and adapted to be heated;

a second member extending at least partially around said barrel and radially from said barrel, wherein said first member and said second member have a spiral profile about said barrel, and said second member being selectively movable along said barrel and adapted to confine a lock of a user's hair between said first member and said second member to enable said lock of hair to be selectively heated; and a first manually actuated member adapted to selectively move said second member along said barrel.

2. A hair curler according to claim 1, wherein said first member and said second member have a substantially identical pitch and cross-section.

3. A hair curler according to claim 2, wherein said cross-section is substantially a square or rectangle.

4. A hair curler according to claim 1, wherein said first manually actuated member is spring-biased away from placing said hair in said confined position.

5. A hair curler according to claim 1, further comprising a clamp adapted to hold the end of a user's hair to enable said hair to be coiled about said hair curler.

6. A hair curler according to claim 5, further comprising a second manually actuated member adapted to open said clamp to allow said hair to be placed within said clamp.

7. A hair curler according to claim 6, wherein said second manually actuated member is spring-biased toward said clamp being in the closed position.

8. A hair curler according to claim 1, further comprising a first manually operated power control for providing power to said hair curler to cause said hair curler to heat.

9. A hair curler according to claim 8, further comprising a second manually operated power control for rapidly increasing said temperature of said barrel by a predetermined amount.

10. A hair curler according to claim 9, wherein said second manually operated power control increases said temperature of said barrel by up to 20 degrees Celsius.

11. A hair curler according to claim 1, further comprising a dial adapted to enable a user to selectively control the temperature of said barrel.

* * * * *